US010895831B2

(12) United States Patent
Yamazaki et al.

(10) Patent No.: US 10,895,831 B2
(45) Date of Patent: Jan. 19, 2021

(54) CONVEYANCE CONTROL DEVICE AND IMAGE READING APPARATUS

(71) Applicants: Kimiharu Yamazaki, Kanagawa (JP); Hideyo Makino, Tokyo (JP); Susumu Mikajiri, Tokyo (JP); Yoshinari Onuma, Kanagawa (JP); Satoshi Nakayama, Kanagawa (JP); Hiroki Yamamura, Kanagawa (JP); Kohta Aoyagi, Kanagawa (JP)

(72) Inventors: Kimiharu Yamazaki, Kanagawa (JP); Hideyo Makino, Tokyo (JP); Susumu Mikajiri, Tokyo (JP); Yoshinari Onuma, Kanagawa (JP); Satoshi Nakayama, Kanagawa (JP); Hiroki Yamamura, Kanagawa (JP); Kohta Aoyagi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/823,081

(22) Filed: Mar. 18, 2020

(65) Prior Publication Data

US 2020/0301326 A1 Sep. 24, 2020

(30) Foreign Application Priority Data

Mar. 19, 2019 (JP) ..... 2019-051511

(51) Int. Cl.
*G03G 15/20* (2006.01)
*G03G 15/00* (2006.01)

(52) U.S. Cl.
CPC ..... *G03G 15/2028* (2013.01); *G03G 15/6573* (2013.01)

(58) Field of Classification Search
CPC ..... G03G 15/6573; G03G 15/2021; G03G 2215/00417
See application file for complete search history.

(56) References Cited

U.S. PATENT DOCUMENTS 10,782,641 B2 * 9/2020 Sekita ..... G03G 15/5062
2005/0008406 A1 1/2005 Nishizaki
(Continued)

FOREIGN PATENT DOCUMENTS

JP 9-267531 10/1997
JP 10-236673 9/1998
(Continued)

*Primary Examiner* — Carla J Therrien
(74) *Attorney, Agent, or Firm* — Duft & Bornsen, PC

(57) ABSTRACT

A conveyance control device includes a fixing device including a first rotary body, a cooling device including a second rotary body, and control circuitry. The circuitry records a first drive amount for the second body when the first and second bodies are driven at a speed, a second drive amount for the second body when the second body is driven without the first body being driven, a third drive amount for the second body when the second body is driven to rotate faster than a rotating speed and the first body is driven, and a fourth drive amount for the second body when the second body is driven to rotate slower than the rotating speed and the first body is driven. The circuitry performs correction based on the drive amounts in such a manner that a drive amount of the second body becomes equivalent to the second drive amount.

5 Claims, 6 Drawing Sheets

(56) References Cited

U.S. PATENT DOCUMENTS

| | | | | |
|---|---|---|---|---|
| 2010/0189447 | A1* | 7/2010 | Ishizuka | G03G 15/5062 399/15 |
| 2012/0201571 | A1 | 8/2012 | Yamazaki et al. | |
| 2014/0308057 | A1* | 10/2014 | Tomino | G03G 15/2017 399/341 |
| 2015/0063889 | A1 | 3/2015 | Kojima | |
| 2019/0166271 | A1 | 5/2019 | Yamazaki et al. | |
| 2020/0264542 | A1* | 8/2020 | Takahashi | G03G 15/657 |

FOREIGN PATENT DOCUMENTS

| | | |
|---|---|---|
| JP | 2001-200858 | 7/2001 |
| JP | 2001-324845 | 11/2001 |
| JP | 2004-219836 | 8/2004 |
| JP | 2005-017422 | 1/2005 |
| JP | 2006-030451 | 2/2006 |
| JP | 2007-304628 | 11/2007 |
| JP | 2008-028737 | 2/2008 |
| JP | 2012-088914 | 5/2012 |
| JP | 2012-177398 | 9/2012 |
| JP | 2013-083763 | 5/2013 |
| JP | 2013-108600 | 6/2013 |
| JP | 2015-065647 | 4/2015 |
| JP | 2015-219275 | 12/2015 |
| JP | 2016-061828 | 4/2016 |
| JP | 2019-103122 | 6/2019 |

* cited by examiner

CONVEYANCE CONTROL DEVICE AND IMAGE READING APPARATUS

CROSS-REFERENCE TO RELATED APPLICATION

This patent application is based on and claims priority pursuant to 35 U.S.C. § 119(a) to Japanese Patent Application No. 2019-051511, filed on Mar. 19, 2019, in the Japan Patent Office, the entire disclosure of which is hereby incorporated by reference herein.

BACKGROUND

Technical Field

Aspects of the present disclosure relates to a conveyance control device and an image reading apparatus.

Related Art

There has been known an image reading apparatus that compares image data generated by optically reading an image formed on a recording medium with an image size at the time of image formation to correct image forming operation of the next image formation. The image reading apparatus may be included in an image forming apparatus.

A conventional image reading apparatus reads, using a reading device, an image (image position) formed on a recording medium and the outer shape of the recording medium (edge position of the medium), and measures the length of the recording medium (medium length) in the conveyance direction using a mechanism included in a conveyance roller. A size of the image formed on the recording medium is then calculated on the basis of the image position, the edge position, and the medium length. An "amount of misalignment" is calculated by comparing the calculated image size with an ideal image size that can be calculated from image data to be used for image formation. A correction value that enables correction of an image forming process is calculated on the basis of the "amount of misalignment", and is fed back to the image forming apparatus. The correction value can be reflected in the image forming process in real time or in non-real time.

SUMMARY

In an aspect of the present disclosure, there is provided A conveyance control device is configured to control conveyance of a sheet-shaped recording medium. The conveyance control device includes a fixing device, a cooling device, and control circuitry. The fixing device includes a first rotary body configured to convey the recording medium. The fixing device is configured to fix an image onto the recording medium. The cooling device includes a second rotary body configured to convey the recording medium. The cooling device is configured to convey the recording medium conveyed from the fixing device while cooling the recording medium. The control circuitry is configured to control rotational operation of the first rotary body and the second rotary body. The control circuitry is configured to record a first drive amount for rotating the second rotary body when the first rotary body and the second rotary body are rotationally driven at a predetermined speed to convey the recording medium, a second drive amount for rotating the second rotary body when the second rotary body is driven without the first rotary body being driven to convey the recording medium, a third drive amount for rotating the second rotary body when the second rotary body is driven to rotate faster than a predetermined rotating speed and the first rotary body is rotationally driven to convey the recording medium, and a fourth drive amount for rotating the second rotary body when the second rotary body is driven to rotate slower than the predetermined rotating speed and the first rotary body is rotationally driven to convey the recording medium. The control circuitry is further configured to perform, when causing the second rotary body to conveys the recording medium, correction based on the first drive amount, the second drive amount, the third drive amount, and the fourth drive amount recorded by the control circuitry, in such a manner that a drive amount of the second rotary body becomes equivalent to the second drive amount to control operation of the second rotary body.

In another aspect of the present disclosure, there is provided an image reading apparatus that includes the conveyance control device and an image reader. The conveyance control device is configured to control conveyance of a recording medium on which an image is formed. The image reader is configured to read a position of the recording medium and the image fixed on the recording medium. The image reader is provided downstream of the conveyance control device in a direction of conveyance of the recording medium.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
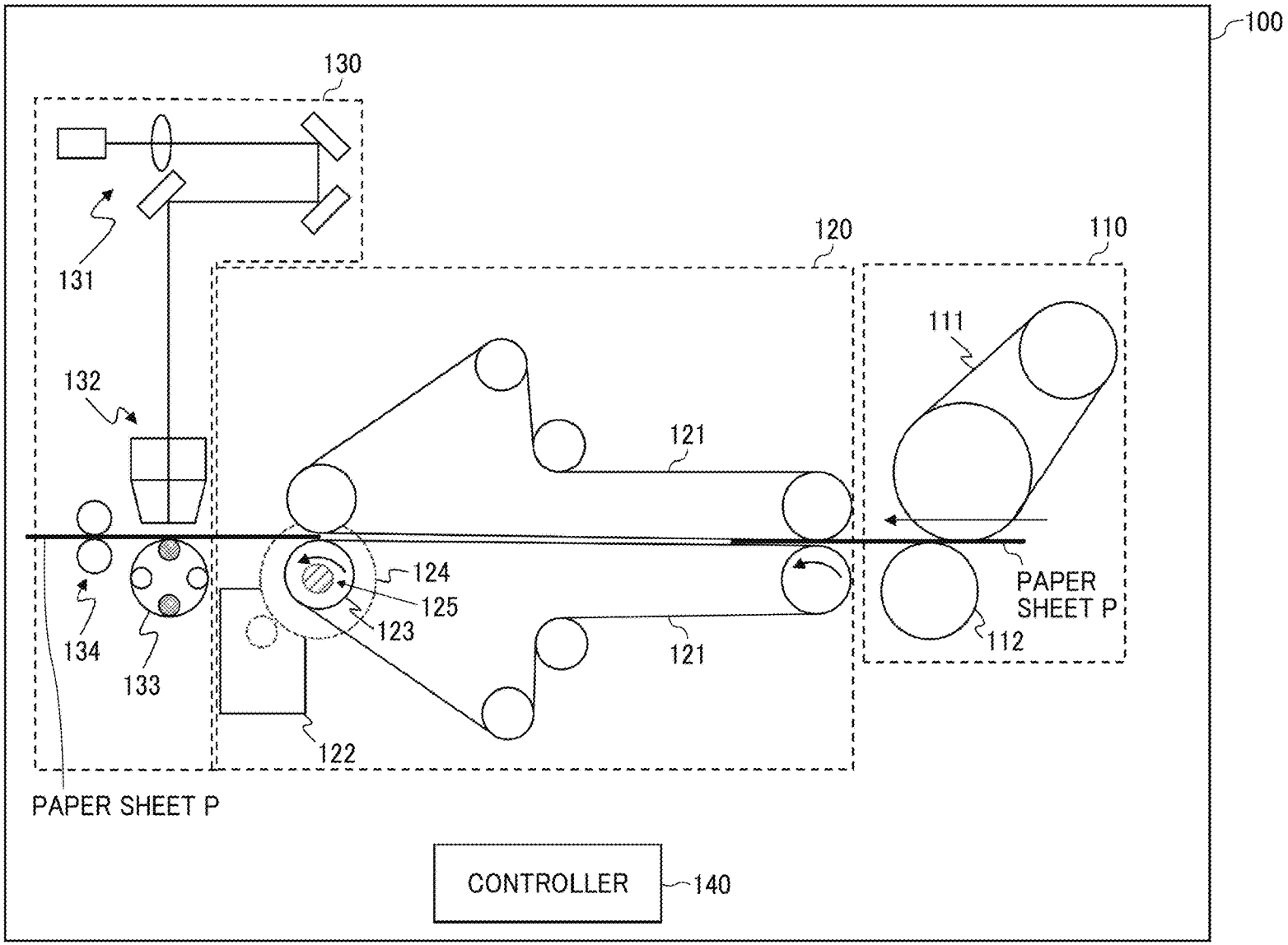
FIG. 1 is a configuration diagram of an image inspection apparatus that is an embodiment of an image reading apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Embodiment of Image Reading Apparatus First, an image reading apparatus according to an embodiment of the present disclosure will be described with reference to the accompanying drawings. FIG. 1 is a configuration diagram exemplifying an outline of an image inspection apparatus 100 that is an embodiment of the image reading apparatus. The image inspection apparatus 100 is an apparatus that reads, as an image, a recording medium bearing an image that has been conveyed, and calculates a correction value to be used to correct image alignment in the next image formation.

The image inspection apparatus 100 includes a fixing device 110 that fixes an image on a paper sheet P, which is an example of a sheet-like recording medium bearing the image, a cooling device 120 that conveys the paper sheet P having passed through the fixing device 110 while cooling the paper sheet P, an image reading unit 130 that is disposed downstream of the cooling device 120 in the conveyance direction and reads, as an image, the paper sheet P having passed through the fixing device 110 and the cooling device 120, and a controller 140 that controls those operations.

The fixing device 110 includes a fixing belt 111 that is a first rotary body, and a pressure roller 112 that sandwiches and presses the fixing belt 111 and the paper sheet P. The fixing belt 111 is stretched around two rollers, and rotates at a predetermined speed by rotation of those rollers. The fixing belt 111 is driven by a motor serving as a drive source that rotationally drives one or both of the two rollers. The controller 140 controls rotational operation of a motor included in the fixing device 110. In other words, the controller 140 controls rotational operation of the fixing belt 111.

The cooling device 120 includes a cooling belt 121 that is a second rotary body, and a cooling device motor 122 to serve as a drive source of rotational operation of the cooling belt 121. The cooling belt 121 includes two belts disposed above and below to form a path for conveying the paper sheet P (conveying path). Each of the two belts is stretched around a plurality of rollers. Among those rollers, for example, a cooling drive roller 123 that is a lower roller disposed on the most downstream side includes a gear 124 to which rotation of the cooling device motor 122 is transmitted.

The gear 124 is attached to the rotary shaft of the cooling drive roller 123, and is disposed to engage with another gear attached to the rotary shaft of the cooling device motor 122.

The cooling drive roller 123 is attached with an encoder 125 for detecting torque and a rotating speed of the rotary shaft. The controller 140 is notified of the rotating speed and torque detected by the encoder 125.

The cooling drive roller 123 rotates at a predetermined speed according to rotation of the cooling device motor 122. The rotational operation of the cooling device motor 122 is controlled by the controller 140. Accordingly, the controller 140 controls the rotational operation of the cooling belt 121. In other words, cooling linear velocity that is a conveyance speed of the paper sheet P in the cooling device 120 is set by the controller 140 that controls rotation of the cooling device motor 122.

The image reading unit 130 includes an image reader 131 that is a reading device, a lighting unit 132, a rotary member 133, and a length-measuring roller 134. The image reader 131 is located above the lighting unit 132, and reads the light reflected from the surface irradiated by the lighting unit 132 to obtain an image of the paper sheet P. The rotary member 133 (revolver) is provided below the lighting unit 132, and the paper sheet P is conveyed between the lighting unit 132 and a background roller included in the rotary member 133.

The image reader 131 starts to obtain the image of the paper sheet P that passes under the lighting unit 132 immediately before the lighting unit 132, and terminates the image acquisition after the paper sheet P has passed just below the lighting unit 132. With the reading operation described above, an image for each paper sheet P can be obtained.

The image reading unit 130 obtains, as an image, the paper sheet P immediately after the image forming process is complete. The image reading unit 130 is disposed downstream of the image inspection apparatus 100 in the conveyance direction, and reads the paper sheet P that has heated by the fixing device 110 so that the image is fixed on the paper sheet P and then conveyed and cooled by the cooling device 120.

The image reading process performed by the image inspection apparatus 100 requires highly accurate reading operation. In view of the above, the space between the lighting unit 132 and the background roller of the rotary member 133 is preferably narrow enough to cause no disadvantage in conveyance so that the recording medium does not flutter. It is also preferable that the length-measuring roller 134 that can be driven highly accurately is provided on the downstream side of the lighting unit 132 in the conveyance direction, and the conveyance is controlled in such a manner that the recording medium does not bend immediately below the lighting unit 132.

In particular, since the downstream of the length-measuring roller 134 in the conveyance direction is an ejection path for ejecting the recording medium, there are disposed two types of conveying paths for face-up (ejection with an image forming surface facing upward in the conveyance direction) and for face-down (ejection with an image forming surface facing downward in the conveyance direction). A curl correction mechanism for suppressing curvature of the recording medium is further disposed. Due to the arrangement of those mechanisms, there are a number of error factors that deteriorate the conveyance performance. Therefore, in order to maintain the reading performance, it is preferable to increase the conveying force of the length-measuring roller 134 and to reduce rotation unevenness.

The controller 140 controls rotational operation of the fixing device 110 and rotational operation of the cooling device 120, and controls a conveyance speed of the recording medium. The controller 140 includes a recording means that records a detection result of the encoder 125 of the cooling device 120 while changing operational states of the fixing device 110 and the cooling device 120. The controller 140 further corrects a speed of conveying the recording medium on the basis of recording results of various operational states recorded in the recording means. Specifically, the operation speed of the cooling device 120 is corrected on the basis of the recording results to suppress conveyance unevenness. The controller 140 is included in control circuitry.

Relationship between Image Formed on Recording Medium and Read Image

Next, "conveyance unevenness" will be described using a relationship between a reading position Rp that is a virtual position at the time when the paper sheet P bearing a formed image is read as an image at a predetermined timing and an actual position on the paper sheet P in the image inspection apparatus 100 according to the present embodiment.

There has been known a technique of adjusting a difference in conveyance speed between a conveyance speed of a sheet feeding unit, a conveyance speed of an image forming unit, and a conveyance speed of a fixing device to stabilize, in an electrophotographic image forming apparatus, a position at which an image formed on an image bearer is transferred to a recording medium.

In order to read, while applying such a technique, a recording medium having been subject to image formation as an image and to accurately correct deviation of the position of the image (transfer position) on the recording medium using a result of the reading, it is preferable to eliminate the influence of an uneven speed of conveying the recording medium (conveyance unevenness).

The conveyance unevenness cumulatively occurs in the sub-scanning direction, which is caused by the influence of a movement error of the recording medium. As the conveyance unevenness accumulates, it may cause an error in size of a read image in the sub-scanning direction in the case of reading the recording medium as an image. Therefore, in order to further improve the accuracy in correcting the image forming position using the image reading apparatus, there may be a problem that an error in reading caused by the conveyance unevenness of the recording medium is to be eliminated.

Figure 2A:
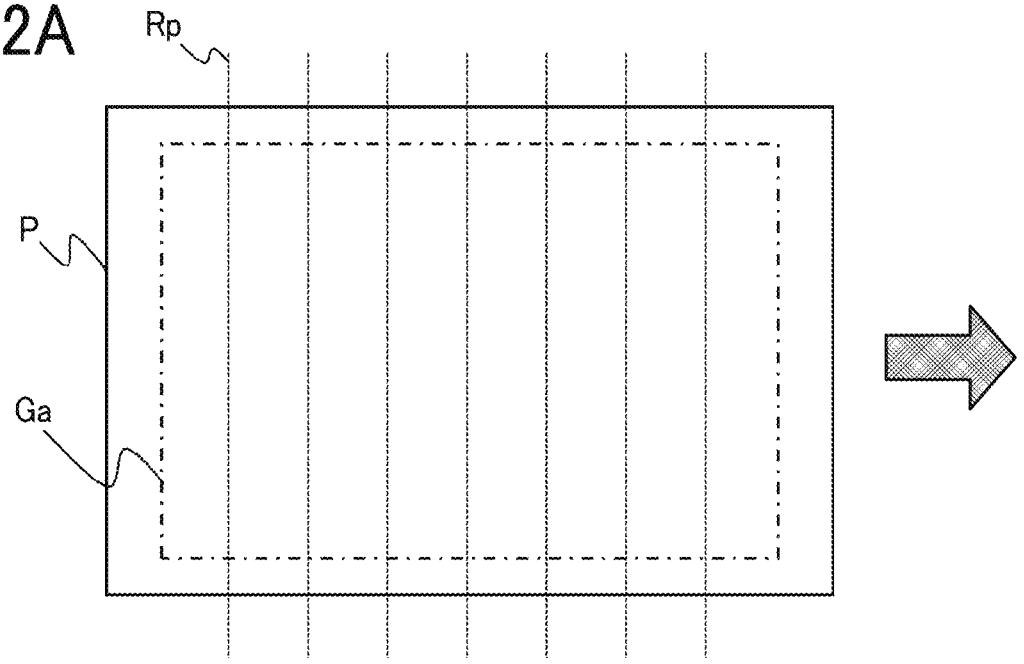
FIGS. 2A to 2C are diagrams illustrating influence of conveyance unevenness that can occur in the image inspection apparatus.

FIG. 2A exemplifies a case where the reading position Rp for an image Ga formed on the paper sheet P has an ideal interval. Note that a thick black arrow clearly indicates the conveyance direction of the paper sheet P. As illustrated in FIG. 2A, in a case where the conveyance speed of the paper sheet P with respect to the image reading unit 130 is ideal (constant and uniform), the reading position Rp is at a position having a constant interval with respect to the conveyance direction of the paper sheet P.

Figure 2B:
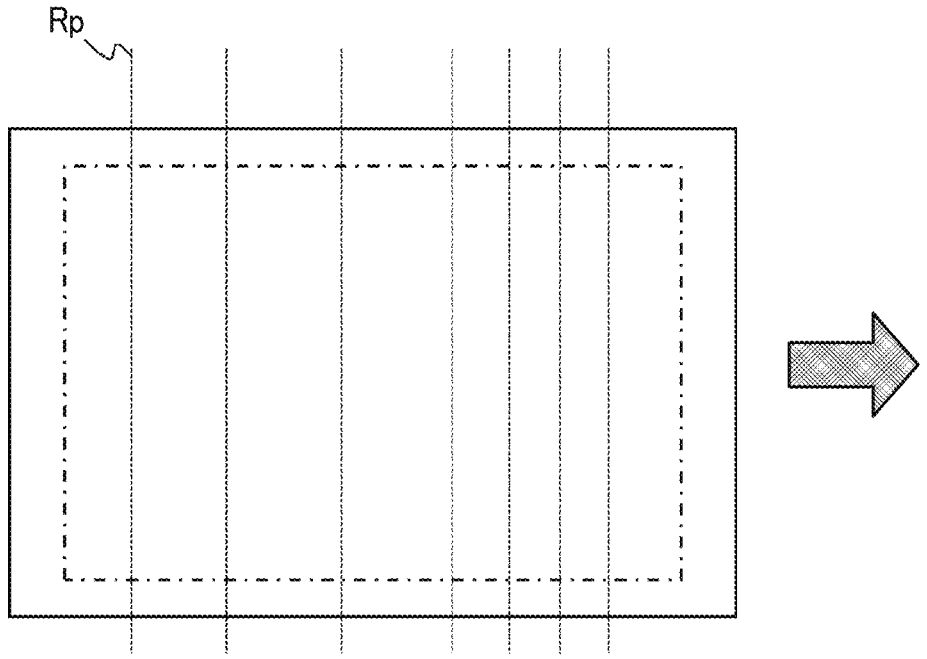

FIG. 2B exemplifies a case where deviation (deflection) occurs in the reading position Rp when the paper sheet P and the image Ga are read by the image inspection apparatus 100. As illustrated in FIG. 2B, when there is unevenness in the conveyance speed during reading of the paper sheet P, the interval between the reading positions Rp is biased according to the conveyance unevenness.

Figure 2C:
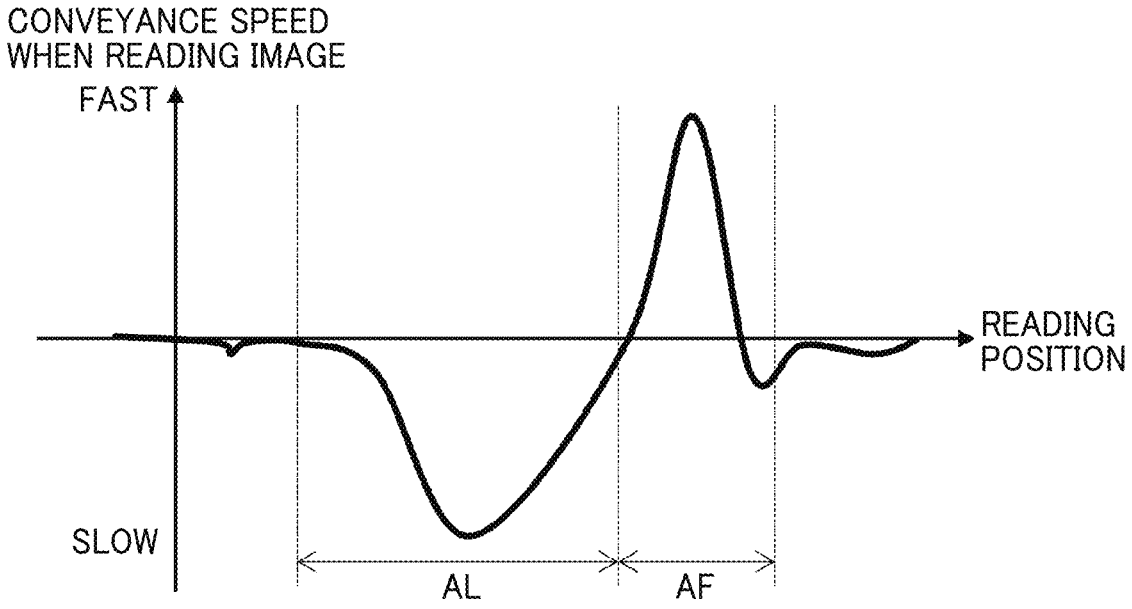

FIG. 2C is a graph exemplifying a state in which, as exemplified in FIG. 2B, the interval between the reading positions Rp is not constant due to the unevenness in speed of conveyance (conveyance unevenness). The graph has a horizontal axis representing the reading position Rp from the beginning in the conveyance direction of the paper sheet P. The vertical axis represents a conveyance speed of the paper sheet P corresponding to the reading position Rp.

As illustrated in FIG. 2C, since the interval between the reading positions extends in a range AL where the conveyance speed is slower than the ideal speed (uniform speed), the read image also extends in the conveyance direction (sub-scanning direction). On the other hand, since the interval between the reading positions is shortened in a range AF where the conveyance speed is faster than the ideal speed (uniform speed), the read image is also shortened in the conveyance direction (sub-scanning direction).

As described above, in a case where the conveyed paper sheet P is read as an image as in the image inspection apparatus 100, it is difficult to control the reading position without any error, and a reading error due to some cause occurs. An example is an error caused by the uneven conveyance speed exemplified in FIGS. 2A to 2C. This error is referred to as a "sub-scanning magnification error".

It is preferable to reduce the unevenness of the conveyance speed with respect to the reading position Rp to reduce the sub-scanning magnification error.

Since an in-line sensor that reads, as an image, the paper sheet P having been subject to image formation like the image inspection apparatus 100 is disposed downstream of the fixing device 110 and the cooling device 120 in the conveyance direction, there are more factors for generating conveyance unevenness than the conveyance unevenness with respect to a secondary transfer unit that transfers an image onto the paper sheet P.

In particular, in the fixing device 110, a roller diameter of rotating the fixing belt 111 and a roller diameter of the pressure roller 112 are likely to change due to the influence of thermal expansion or the like, and the conveyance speed (sheet linear velocity) in the fixing device 110 is easily changed by the influence. When the sheet linear velocity in the fixing device 110 changes, a difference (linear velocity difference) from the conveyance speed in the cooling device 120 occurs. When the linear velocity difference occurs between the fixing device 110 and the cooling device 120, shock jitter is likely to occur when the rear end of the paper sheet Pin the conveyance direction passes through the fixing device 110.

When the shock jitter occurs due to the exit of the rear end of the paper sheet Pin the conveyance direction, the conveyance speed also fluctuates in the cooling device 120 disposed downstream. As a result, the influence exerted by fluctuations of the conveyance speed of the paper sheet P also occurs when the image reading unit 130 disposed downstream of the cooling device 120 is reading the paper sheet P.

This influence is the "sub-scanning magnification error" described above. Therefore, it is preferable to reduce the linear velocity difference between the rollers that determines the conveyance speed of the paper sheet P to eliminate the "sub-scanning magnification error".

Figure 3A:
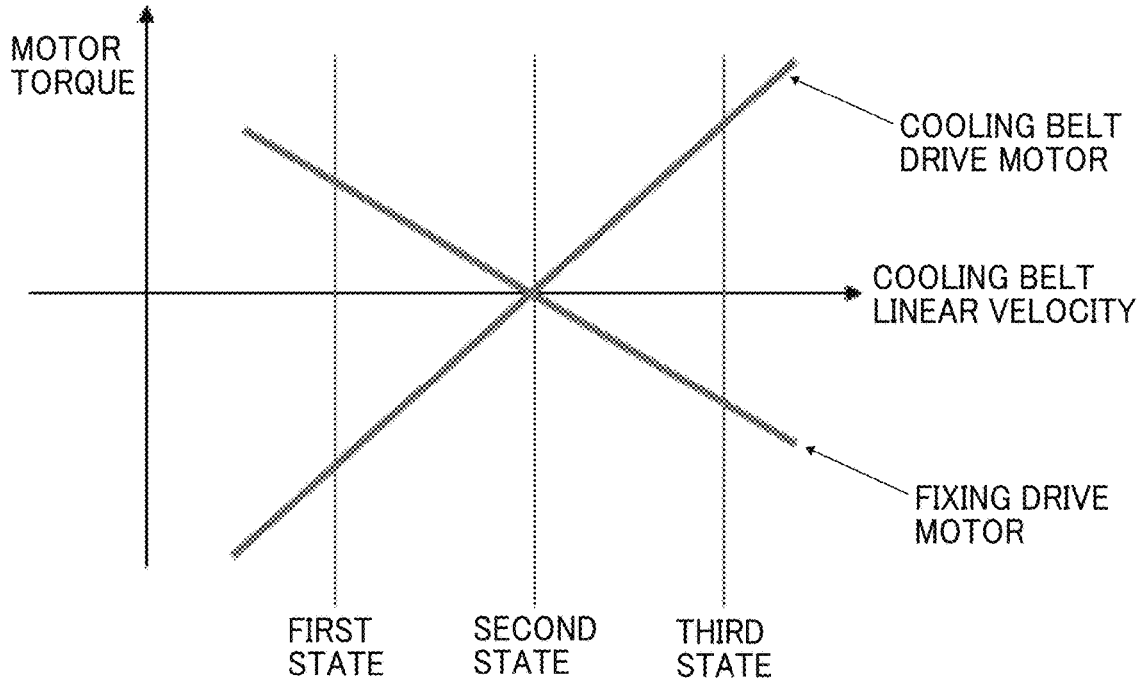
FIGS. 3A and 3B are graphs illustrating influence of conveyance unevenness that can occur in the image inspection apparatus.
Figure 3B:
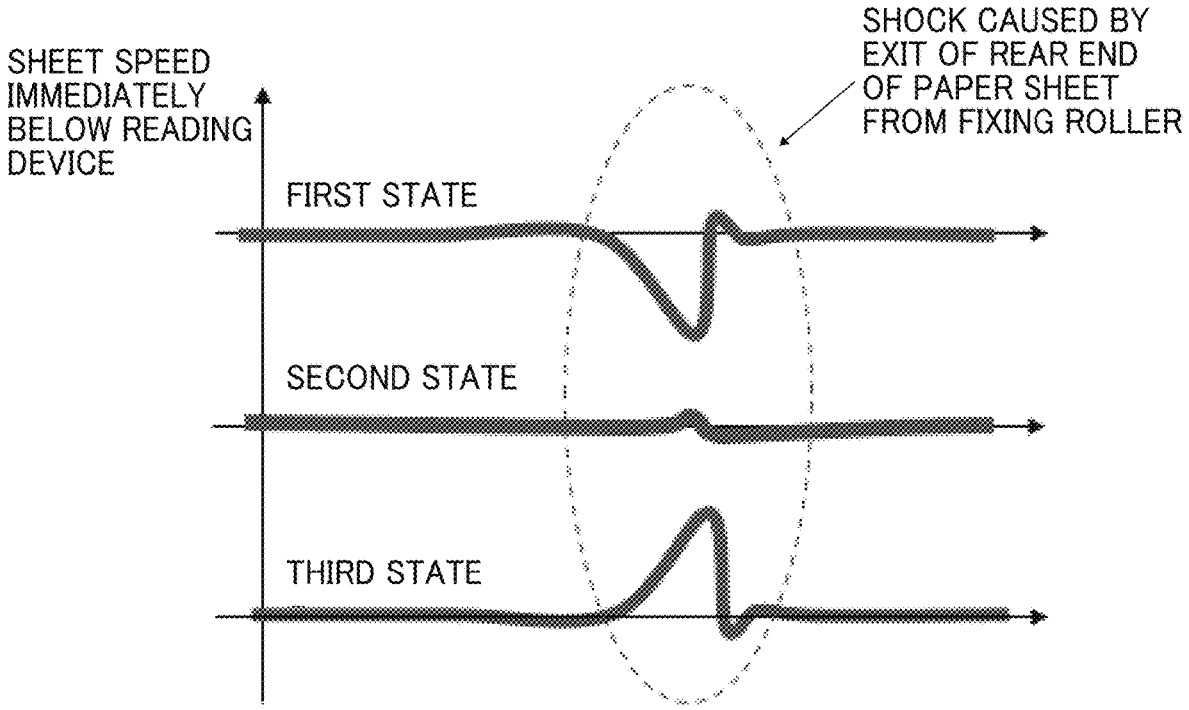

Relationship Between Difference in Linear Velocity Between Cooling Belt and Fixing Belt and Shock Jitter FIGS. 3A and 3B are graphs illustrating a relationship between linear velocity of the cooling belt 121 (cooling belt linear velocity), a torque of the cooling drive roller 123 (cooling belt drive motor torque), and a torque of the motor for rotating the fixing belt 111 (fixing drive motor torque), and a relationship between the above-described relationship and shock jitter that occurs at the time when, while the paper sheet P moves from the fixing device 110 toward the cooling device 120, the rear end of the paper sheet P passes through the nip between the fixing belt 111 and the pressure roller 112.

In a state where the cooling belt linear velocity is slower than the fixing roller linear velocity (first state), the fixing belt 111 pushes the paper sheet P. In this case, the torque of the fixing drive motor increases. At the time when the rear end of the paper sheet P passes through, the assisted force from the fixing belt 111 is lost, whereby the sheet linear velocity decreases for a moment.

To the contrary, when the cooling belt linear velocity is higher than the fixing roller linear velocity (second state), the fixing belt 111 constantly pulls the paper sheet P (brake is applied). In this case, the speed increases for a moment at the time when the rear end of the paper sheet P passes through the fixing belt 111. Therefore, as illustrated in the second state, the cooling linear velocity is required to be set to reduce the shock caused by the exit of the rear end of the paper sheet.

The cooling drive motor torque in the condition of the second state is a torque after the paper sheet P has passed through the fixing belt 111 (torque in the state where the cooling belt 121 is conveying the paper sheet P alone). Therefore, in order to read the paper sheet P in the image reading unit 130 under the condition that an abnormal image due to fluctuations in the reading situation or the "sub-scanning magnification error deviation" does not occur, the torque of the cooling device motor 122 to be the condition for the second state is required to be known in advance.

Calculation of Optimum Value of Cooling Belt Linear Velocity

Next, a method for obtaining, in the image inspection apparatus 100 according to the present embodiment, an optimum value of torque control for the cooling device motor 122 for reducing the "sub-scanning magnification error deviation" due to the conveyance speed unevenness at the time of image reading will be described.

Figure 4:
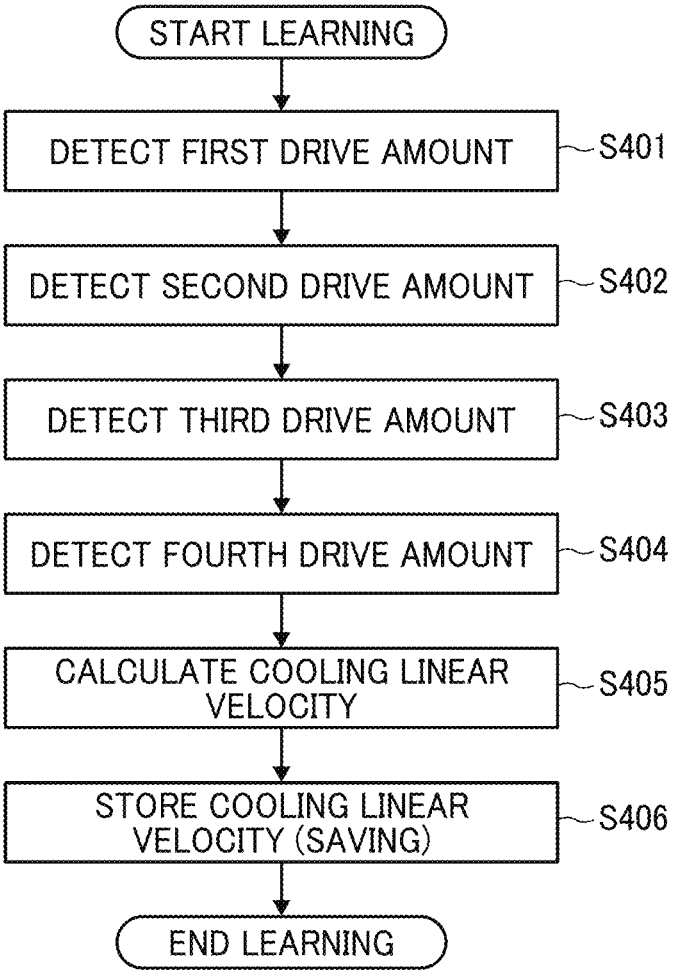
FIG. 4 is a flowchart illustrating a method for learning cooling linear velocity control that can be executed by the image inspection apparatus.

FIG. 4 is a flowchart illustrating a learning method for deriving an optimum value of the cooling belt linear velocity. The optimum value of the cooling belt linear velocity differs depending on a "paper type", such as a material and thickness of the paper sheet P, to obtain the optimum value precisely. Therefore, the method to be described below is executed for each predetermined paper type, and the optimum value calculated for each paper type is stored in a storage included in the controller 140. When a paper type to be inspected is input to the image inspection apparatus 100, the optimum value corresponding to the paper type, which is stored in the storage, is read and used for torque control of the cooling device motor 122. Note that the condition for the optimum value related to the paper type varies depending on usage environment, such as temperature environment and humidity environment. In view of the above, it is sufficient if the optimum value is calculated and stored for each usage environment that can be expected beforehand.

Note that the optimum value obtained by the learning method to be described below may be a different value even under the same conditions due to environmental changes and time-based deterioration of the image inspection apparatus 100. In that case, it is sufficient if the learning method is executed again to update the optimum value.

Learning Method Executed in Image Inspection Apparatus

In the image inspection apparatus 100 operating in a learning mode, the paper sheet P is caused to flow (conveyed) on the conveying path. At this time, the paper sheet P is conveyed using both of the fixing device 110 and the cooling device 120, the torque of the cooling device motor 122 at this time is detected by the encoder 125, and is notified to the controller 140 (S401). The torque detected in S401 is set as a first drive amount.

Subsequently, the cooling device 120 operates alone (with the fixing device 110 being stopped) to convey the paper sheet P, the torque of the cooling device motor 122 at this time is detected by the encoder 125, and is notified to the controller 140 (S402). The torque detected in S402 is set as a second drive amount.

Subsequently, the cooling linear velocity is set to be higher than the cooling linear velocity in S401 (rotating speed of cooling device motor 122 is increased). Then, in a similar manner to S401, the paper sheet P is conveyed using both of the fixing device 110 and the cooling device 120, the torque of the cooling device motor 122 at this time is detected by the encoder 125, and is notified to the controller 140 (S403). The torque detected in S403 is set as a third drive amount.

Subsequently, the cooling linear velocity is set to be slower than the cooling linear velocity in S401 (rotating speed of cooling device motor 122 is decreased). Then, in a similar manner to S401, the paper sheet P is conveyed using both of the fixing device 110 and the cooling device 120, the torque of the cooling device motor 122 at this time is detected by the encoder 125, and is notified to the controller 140 (S404). The torque detected in S404 is set as a fourth drive amount.

Here, to "increase the cooling linear velocity" indicates, when the cooling linear velocity in S401 is set as a speed of normally conveying the paper sheet P and this speed is defined as a speed of neutrality (neutral speed), a speed several percent faster than the neutral speed. In addition, to "decrease the cooling linear velocity" indicates a speed several percent slower than the cooling linear velocity (neutral speed) in S401.

Subsequently, in each of S401, S402, and S403, a cooling linear velocity to have torque same as the torque detected in S402 is calculated on the basis of the torque of the cooling device motor 122 notified to the controller 140 (S405). In other words, the controller 140 calculates cooling linear velocity in which the torque (drive amount) of the cooling belt 121, which is the second rotary body, is equivalent to the second drive amount on the basis of the first drive amount, the second drive amount, the third drive amount, and the fourth drive amount.

The controller 140 stores the cooling linear velocity calculated in S405 in association with a usage condition (type of the paper sheet P, etc.) set at the start of the learning mode (S406).

When the image inspection apparatus 100 executes image reading operation, the controller 140 reads the cooling linear velocity corresponding to the selected usage condition from the storage, and controls, using the cooling linear velocity, the conveyance speed in the cooling device 120. That is, the controller 140 performs control while correcting the torque of the cooling device motor 122 in such a manner that the cooling linear velocity of the cooling belt 121 becomes the cooling linear velocity recorded in S406.

The cooling device 120 and the controller 140 correspond to the conveyance control device according to an embodiment of the present disclosure.

Another Embodiment of Image Reading Apparatus

Figure 5:
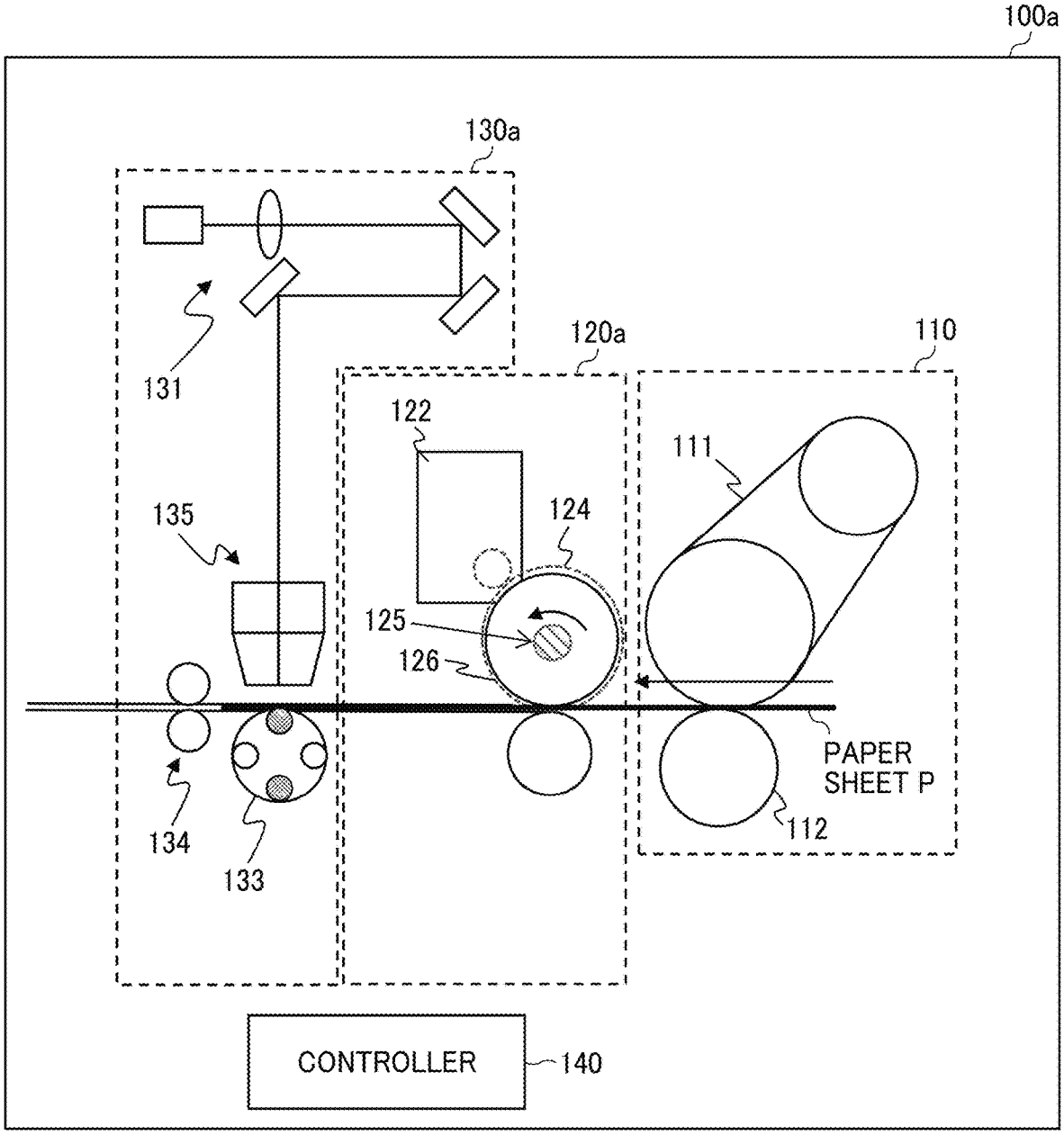
FIG. 5 is a configuration diagram illustrating another exemplary configuration of the image inspection apparatus.

Next, the image reading apparatus according to another embodiment of the present disclosure will be described with reference to FIG. 5. FIG. 5 is a configuration diagram exemplifying an outline of an image inspection apparatus 100*a* according to the present embodiment. The image inspection apparatus 100*a* has a plurality of configurations similar to the configuration of the image inspection apparatus 100 that has already been described. Hereinafter, different configurations will be mainly described.

A major difference from the image inspection apparatus 100 is a configuration of a cooling device 120*a*. The cooling device 120 that has already been described employs a "cooling belt system" using the cooling belt 121. Meanwhile, the cooling device 120*a* according to the present embodiment employs a "cooling roller system" using a cooling roller 126 and a cooling pressure roller 127.

Furthermore, a reading device 135 included in an image reading unit 110*a* constitutes a unity magnification optical system instead of the lighting unit 132. For example, it is configured using a contact image sensor (CIS).

Note that control of cooling linear velocity in the image inspection apparatus 100*a* is similar to the method for controlling the image inspection apparatus 100, and detailed descriptions will be omitted.

The present disclosure is not limited to the embodiments described above and various modifications can be made without departing from the technical scope of the present disclosure, and all technical items included in the technical ideas described in the appended claims are the subject of the present disclosure. While the embodiments described above illustrate preferable examples, those skilled in the art can achieve various modified examples from the disclosed contents. Such modified examples are also included in the technical scope described in the appended claims.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A conveyance control device configured to control conveyance of a sheet-shaped recording medium, the conveyance control device comprising:

a fixing device including a first rotary body configured to convey the recording medium, the fixing device being configured to fix an image onto the recording medium;

a cooling device including a second rotary body configured to convey the recording medium, the cooling device being configured to convey the recording medium conveyed from the fixing device while cooling the recording medium; and control circuitry configured to control rotational operation of the first rotary body and the second rotary body, wherein the control circuitry is configured to record:

a first drive amount for rotating the second rotary body when the first rotary body and the second rotary body are rotationally driven at a predetermined speed to convey the recording medium;

a second drive amount for rotating the second rotary body when the second rotary body is driven without the first rotary body being driven to convey the recording medium;

a third drive amount for rotating the second rotary body when the second rotary body is driven to rotate faster than a predetermined rotating speed and the first rotary body is rotationally driven to convey the recording medium; and a fourth drive amount for rotating the second rotary body when the second rotary body is driven to rotate slower than the predetermined rotating speed and the first rotary body is rotationally driven to convey the recording medium, and the control circuitry is further configured to perform, when causing the second rotary body to convey the recording medium, correction based on the first drive amount, the second drive amount, the third drive amount, and the fourth drive amount recorded by the control circuitry, in such a manner that a drive amount of the second rotary body becomes equivalent to the second drive amount to control operation of the second rotary body.

2. The conveyance control device according to claim 1, wherein the first drive amount, the second drive amount, the third drive amount, and the fourth drive amount are torque of a motor being a drive source configured to rotate the second rotary body.

3. The conveyance control device according to claim 1, wherein the fixing device includes a fixing roller and a fixing belt, the cooling device includes a cooling roller and a cooling belt, and each of the first drive amount, the second drive amount, the third drive amount, and the fourth drive amount for rotating the second rotary body is torque of a motor configured to rotate the cooling roller.

4. The conveyance control device according to claim 1, wherein the control circuitry varies the correction depending on a type of the recording medium.

5. An image reading apparatus comprising:

the conveyance control device according to claim 1 configured to control conveyance of a recording medium on which an image is formed; and an image reader configured to read a position of the recording medium and the image fixed on the recording medium, the image reader being provided downstream of the conveyance control device in a direction of conveyance of the recording medium.

* * * * *